US009300082B2

(12) United States Patent
Underwood

(10) Patent No.: US 9,300,082 B2
(45) Date of Patent: Mar. 29, 2016

(54) ELECTRICAL CONNECTORS

(71) Applicant: IFPL Group Limited, Calbourne, Isle of Wight (GB)

(72) Inventor: Geoffrey Paul Underwood, Calbourne (GB)

(73) Assignee: IFPL GROUP LIMITED, Calbourne (GB)

( * ) Notice: Subject to any disclaimer, the term of this patent is extended or adjusted under 35 U.S.C. 154(b) by 0 days.

(21) Appl. No.: 14/039,089

(22) Filed: Sep. 27, 2013

(65) Prior Publication Data

US 2015/0093918 A1 Apr. 2, 2015

(51) Int. Cl.

| | |
|---|---|
| ***H01R 13/62*** | (2006.01) |
| ***H01R 13/633*** | (2006.01) |
| *H01R 105/00* | (2006.01) |
| *H01R 24/28* | (2011.01) |

(52) U.S. Cl.

CPC ..... *H01R 13/6205* (2013.01); *H01R 13/633* (2013.01); *H01R 24/28* (2013.01); *H01R 2105/00* (2013.01)

(58) Field of Classification Search

CPC ..... H01R 13/6205
USPC ..... 439/924.1
See application file for complete search history.

(56) References Cited

U.S. PATENT DOCUMENTS 1,978,076 A * 10/1934 Cassedy, Jr. ..... H01R 23/26 439/680
2,135,267 A * 11/1938 Alden ..... H01J 5/50 439/379
2,297,188 A * 9/1942 Joyce ..... H01R 29/00 307/149
3,383,588 A * 5/1968 Stoll ..... G01R 31/024 324/508
3,432,795 A * 3/1969 Jayne ..... H01R 13/631 439/60
3,569,908 A * 3/1971 Appleton ..... H01R 13/707 335/170
3,933,404 A * 1/1976 Oehlerking ..... H01R 13/56 439/188
4,034,172 A * 7/1977 Glover ..... H01R 13/703 200/51.1
4,084,875 A * 4/1978 Yamamoto ..... H01R 13/629 340/687
4,118,690 A * 10/1978 Paynton ..... H01R 13/7177 324/508
4,124,877 A * 11/1978 Vollenweider ..... H05K 5/0017 200/11 TW
4,483,575 A * 11/1984 Kruger ..... H01R 13/6215 439/102
4,529,861 A * 7/1985 Blanton ..... B23K 9/323 219/137.63
4,628,392 A * 12/1986 Didier ..... E21B 33/0407 200/51.04
4,927,382 A * 5/1990 Huber ..... H01R 13/641 340/687
5,174,787 A * 12/1992 Shirai ..... H01R 13/641 439/489
5,176,528 A * 1/1993 Fry ..... H01R 12/724 439/181
5,346,406 A * 9/1994 Hoffman ..... H01R 23/10 439/474
5,384,492 A * 1/1995 Carlson ..... H02H 9/004 307/147
5,476,386 A * 12/1995 Booth ..... H01H 9/0207 439/40
5,591,035 A * 1/1997 Burkholder ..... H01R 12/724 439/79
5,655,916 A * 8/1997 Hayashi ..... H01R 13/641 439/153

(Continued)

*Primary Examiner* — Ross Gushi
(74) *Attorney, Agent, or Firm* — Tillman Wright, PLLC; James D. Wright; David R. Higgins

(57) ABSTRACT

A plug (1) for electrical equipment comprising a housing and a plurality of projections (2, 4, 5) extending from the housing, wherein first and second projections are larger than a third projection, and the projections are arranged so as to facilitate disengagement of the plug from the socket.

4 Claims, 1 Drawing Sheet

(56) References Cited

U.S. PATENT DOCUMENTS 5,873,737 A * 2/1999 Hashizawa ..... B60L 11/1818 439/310
5,909,065 A * 6/1999 Jones ..... H02H 9/004 307/147
6,338,657 B1 * 1/2002 Harper ..... A61B 18/14 439/598
6,392,901 B1 * 5/2002 Colver ..... H05K 7/1457 312/223.2
6,447,309 B1 * 9/2002 Ko ..... H01R 12/7088 439/106
6,494,734 B1 * 12/2002 Shuey ..... H01R 23/688 439/284
6,683,273 B2 * 1/2004 Conway ..... H01R 13/005 219/121.48
7,604,505 B2 * 10/2009 Zayas ..... H01J 5/54 439/236
7,666,027 B2 * 2/2010 Takehara ..... H01R 13/641 439/157
7,736,197 B2 * 6/2010 Takeda ..... H01R 13/6456 439/680
7,740,498 B1 * 6/2010 Orsley ..... H01R 12/79 439/218
7,789,714 B2 * 9/2010 Liu ..... H01R 12/58 439/682
7,988,494 B2 * 8/2011 Lee ..... H01R 13/713 439/652
8,152,558 B2 * 4/2012 Broeksteeg ..... B60R 11/0241 439/378
8,672,696 B2 * 3/2014 Sakurai ..... H01R 13/6315 439/247
8,866,485 B1 * 10/2014 Lacey ..... H01R 25/003 324/508

* cited by examiner

ELECTRICAL CONNECTORS

TECHNICAL FIELD

The present invention relates generally to electrical connectors, and in particular, although not exclusively, to plugs and jacks for use with electrical equipment, such as headsets.

BACKGROUND

Jack and plug connectors are known to enable user equipment, such as headphones, to be connected to host equipment, such as a passenger entertainment system. Whilst the plug is inserted in the jack it is possible that the user will move the headphones relative to the point of connection between the plug and the jack. If the user attempts to move the headphones beyond the length of the cable (which connects the plug to the headphones) a force will be applied to the plug and the jack by the cable. This means that the cable, the jack and/or the plug could be damaged as a result of the force applied.

Accordingly, a need exists for an improved electrical connector.

SUMMARY

According to one aspect of the invention there is provided a plug for electrical equipment comprising a housing and a plurality of projections extending from the housing for receipt by a socket and for electrical connection therewith, wherein first and second projections may be longer than a third projection, and wherein the third projection may be substantially shorter than the first and second projections.

The third projection may be thirty percent, or less, of lengths of the first and second projections. The third projection may be 20%, or less, of lengths of the first and second projections.

The first and second projections may be of substantially the same length.

The third projection may be substantially shorter than the first and second projections.

The plug may comprise a magnet or ferrous portion which is arranged to generate a magnetic retaining force between the plug and the socket. The portion may be provided substantially centrally of the projections.

The magnetic retaining force may be sufficient to help retain the plug in a connected condition with the socket, however the magnetic retaining force is not large enough to prevent the plug from being disengaged from the socket.

Each of the first and second projections may comprise an electrical contact portion for a noise cancellation signal and an electrical contact portion for an audio signal. The electrical contact portions may comprise a sleeve contact and a tip contact.

The first and second projections may comprise electrical pins.

The third projection may be of substantially squat form.

According to another aspect of the invention there is provided a socket arranged to interface with the plug of the first aspect of the invention.

Yet a further aspect of the invention relates to a plug of the first aspect of the invention and a socket of the second aspect of the invention.

Further aspects of the invention may comprise any combination of the above aspects and/or features in the detailed description and/or drawings.

BRIEF DESCRIPTION OF THE DRAWINGS

Various embodiments of the invention will now be described, by way of example only, with reference to the following drawings in which.

DETAILED DESCRIPTION

Figure 1:
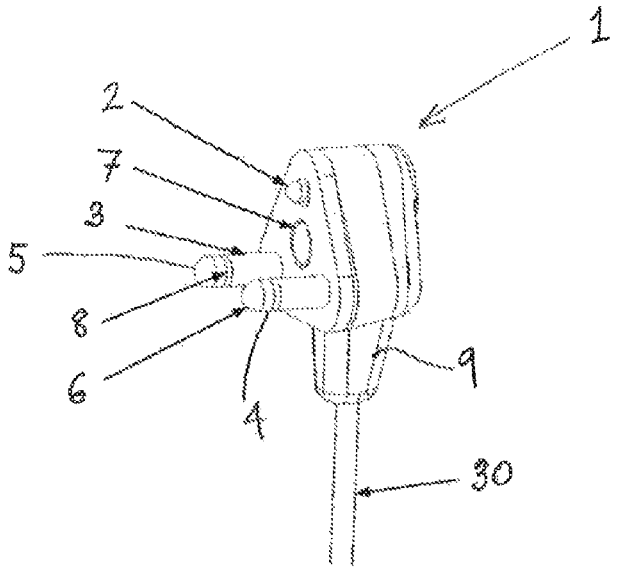
FIG. 1 is a perspective view of a plug.
Figure 2:
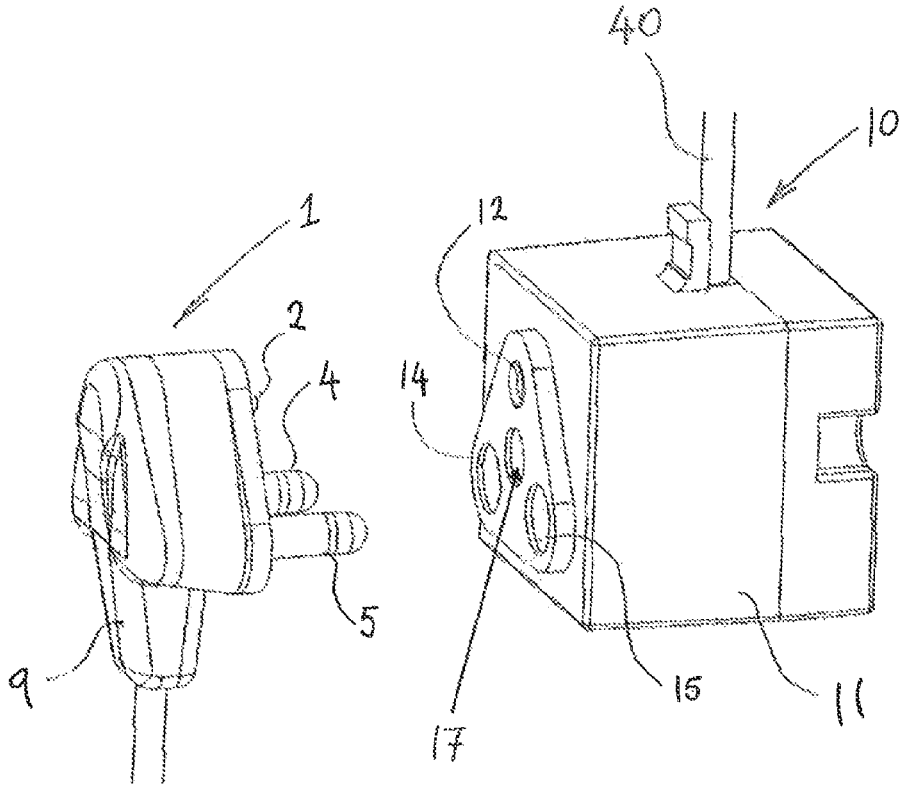
FIG. 2 is a perspective view of a plug and a socket.

With reference to FIG. 1, there is shown a plug 1 for electrical equipment comprising a housing, and two pins 4 and 5, extending from a front side of the housing. As will be described below, the plug 1 is advantageously arranged to facilitate ease of removal from a socket. Of particular application is the fact that in the event that the user (for example the wearer of an audio headset connected to the plug) moves beyond the length of the cable connecting the equipment to the plug, the plug 1 can easily break away from its mating, in a quick-release manner, without causing damage to the plug or the socket.

Each of the pins 4 and 5 comprises a sleeve electrical contact 3 and a tip electrical contact 6 each electronically insulated from the other by an insulator 8. The plug 1 is connected to a headphone apparatus wherein one contact of each pin provides an audio signal and the other contact provides a noise-cancelling signal comprising a microphone signal.

A third projection 2, which also extends from the front surface, is of relatively squat profile. The projection 2 comprises an electrical return contact. The projection 2 is received in electrical contact by an electronically conductive bezel provided in a power socket/jack. The projection 2 may be viewed as a short return. The projection 2 is of substantially shorter length than the pins 4 and 5, and may be considered as having only negligible length as compared to the pins 4 and 5. The projection 2 may be viewed as a purely rounded formation, without any significant (relative) length. The projection 2 essentially consists of a rounded electrical formation which is substantially shorter than the pins 4 and 5.

It will be appreciated that all three of the projections/pins are of shorter length as compared to those on a standard plug. This, at least in part, assists removal of the plug from the socket. The pins 4 and 5 are approximately two-thirds of the length of the ARINC 628 standard.

The plug 1 further comprises a magnet 7 which is located substantially centrally of the projections. The magnet 7 is embedded in the forward surface of the plug 1. The magnet serves, in use, to provide a retaining force to assist in retaining the plug 1 in a connected condition with the socket. However, the retaining force provided by the magnet is not so large as to prevent the plug 1 from being disengaged from the audio jack socket.

The plug 1 is connected to an audio headset by way of a cable 30.

The socket 10, or jack unit, comprises a housing 11, arranged to fit into a standard aircraft aperture for an inflight passenger entertainment system. The housing 11 comprises a plug interface region which is arranged to interface with the plug 1. The interface region comprises three apertures arranged in triangular formation. Two apertures 14 and 15 are arranged to receive respective pins 4 and 5 of the plug 1. An electrical contact arrangement is provided within each aperture and each is arranged to contact with a respective conductive portion of each pin, and provide suitable electrical signals thereto.

An aperture 12, comprising the metallic bezel, is arranged to receive the return projection 2, and thereby the return signal. Located substantially centrally of the apertures there is provided a recess 17 which is either magnetised or metallic. The position of the recess 17 corresponds to the relative position of the magnet 7 of the plug 1.

The socket 10 comprises electrical cable/wiring 40 which connects to a source of audio signals from an on-board passenger entertainment system.

In use, the socket 10 is installed in or adjacent to passengers seated in an aircraft. Should the passenger wish to use the onboard entertainment system, he can push the plug 1 (of his audio headset) into the socket 10. In so doing, the pins 4 and 5 are received in the respective apertures 14 and 15, and the return contact 2 is received (in electrical connection) with the metal bezel 12. A magnetic attraction force exists between the magnetic/metallic component of the recess 17 of the socket and the magnet 7 of the plug. This ensures that whilst in use the plug 1 is maintained connected to the socket 10. In the event that the user inadvertently, whilst wearing the headset, moves beyond the length of the cable, this will cause a pulling force to be applied to the plug 1. This may come about as a result of the user attempting to get up out of his seat, but forgetting to remove the headset before doing so. With conventional plugs this would result in potentially damaging forces being applied to both the headset and the plug since the plug would be retained in the socket. Moreover, with the plug 1, the lengths of the projections received by the socket, and the strength of the magnetic retaining force, are such that when such a pulling force is applied to the plug, the plug is disengaged from the socket, in a quick-release manner, and thereby minimising the potentially damaging forces which could be applied. Advantageously, even if the pulling force is applied at a high angle to the plug (and thereby reducing the pulling force/vector component), the plug 1 will nevertheless become disengaged. The quick release process is assisted by the rigid cable entry sleeve 9, which causes a leverage to be applied to the plug 1, thereby further facilitating the disengagement.

Advantageously, the socket 10 is backwards compatible in that it is capable of also allowing known plugs (with electrical pins) to be used therewith, for example of the type which comprise a pin in which the various terminals are spaced along the length of the pin (and electrically isolated from each other). On insertion of such a known plug type, the, or each, of the terminals of the (known) pin will contact a respective terminal contact located internally of the apertures. The socket 10 therefore has the versatility to accept the plug 1, or a known plug type, and so is not restricted to use of the former.

In an alternative embodiment, each of the two long pins is provided with only one electrical contact, as opposed to each having two.

Although the above embodiment finds particular application in the field of headphones (and is of particular advantage in the field of (inflight or otherwise) passenger entertainment), modified embodiments also find application in relation to plug and socket arrangements for transmission of data generally, or indeed any electrical signal, and not solely audio signals and/or power.

The invention claimed is:

1. A plug for electrical equipment comprising a housing and a plurality of projections extending from the housing for receipt by a socket and for electrical connection therewith, wherein first and second projections are longer than a third projection, the projections being arranged in a triangular arrangement, wherein the projections are arranged to facilitate disengagement of the plug from a socket, wherein the plug is arranged to mate with the socket, but being capable of intentionally overcoming the mating so as to avoid damage to the plug and/or socket in the event of a sufficient pulling force applied to the plug, and wherein the plug further comprises a magnet or ferrous portion which is arranged to provide a magnetic retaining force between the plug and the socket.

2. The plug of claim 1, wherein the magnetic retaining force is sufficient to help retain the plug in a connected condition with the socket, however the magnetic retaining force is not large enough to prevent the plug from being disengaged from the socket.

3. A plug for electrical equipment comprising a housing and a plurality of projections extending from the housing for receipt by a socket and for electrical connection therewith, wherein first and second projections are longer than a third projection, wherein the projections are arranged to facilitate disengagement of the plug from a socket, and further comprising a magnet or ferrous portion which is arranged to provide a magnetic retaining force between the plug and the socket.

4. The plug of claim 3, wherein the magnetic retaining force is sufficient to help retain the plug in a connected condition with the socket, however the magnetic retaining force is not large enough to prevent the plug from being disengaged from the socket.

* * * * *